US005779208A

United States Patent [19]

McGraw

[11] Patent Number: 5,779,208

[45] Date of Patent: Jul. 14, 1998

[54] MOVABLE STEP PLATFORM FOR LADDERS

[76] Inventor: Raymond V. McGraw, 1427 Bussard Ct., Arden Hills, Minn. 55112

[21] Appl. No.: 756,262

[22] Filed: Nov. 25, 1996

[51] Int. Cl.[6] ..... E04G 3/08

[52] U.S. Cl. ..... 248/238; 182/120

[58] Field of Search ..... 248/238, 210, 248/229.22, 242; 182/120, 122, 103, 222

[56] References Cited

U.S. PATENT DOCUMENTS

| | | | |
|---|---|---|---|
| 335,051 | 1/1886 | Ayres . | |
| 1,285,817 | 11/1918 | Sklar | 182/120 |
| 1,890,763 | 12/1932 | Wilson . | |
| 2,174,891 | 10/1939 | Maran | 248/210 |
| 2,486,783 | 11/1949 | Hartman et al. | 304/31.5 |
| 2,585,150 | 2/1952 | McGill | 304/31.5 |
| 2,730,412 | 1/1956 | Yoder | 304/31.5 |
| 2,805,104 | 9/1957 | Johnson | 304/31.5 |
| 2,827,336 | 3/1958 | Johnson | 304/31.5 |
| 2,838,342 | 6/1958 | Masse | 248/238 |
| 2,899,011 | 8/1959 | Babits | 182/120 |
| 3,294,197 | 12/1966 | Kwiatkowski | 182/120 |
| 5,056,620 | 10/1991 | Zumwalt et al. | 248/238 |
| 5,337,857 | 8/1994 | Spalt et al. | 182/120 |

*Primary Examiner*—Ramon O. Ramirez
*Assistant Examiner*—Anita M. King
*Attorney, Agent, or Firm*—Haugen and Nikolai, P.A.

[57] ABSTRACT

An adjustably positionable support platform for use in combination with an extension ladder which includes a generally planar deck having a load supporting assembly to accommodate a person standing thereon. The load bearing assembly comprises a plate with a foot supporting upper surface and a ladder rung engaging lower surface. A first pair of support pins is provided for slidable engagement within brackets attached to the lower rung engaging surface, the first pair of pins being arranged to capture a ladder rung between the pin and the lower rung engaging surface. A second pair of pins is provided with a distally positioned ladder rail engaging plate to control the angular disposition of the deck so as to provide a horizontal standing surface for the user. Additionally, the plate of the load bearing assembly is provided with angularly downwardly extending flanges, with the included angle between the front flange and the plate preferably being about 75 degrees.

4 Claims, 5 Drawing Sheets

MOVABLE STEP PLATFORM FOR LADDERS

BACKGROUND OF THE INVENTION

The present invention relates generally to an improved adjustably positionable support platform for use in combination with a conventional extension ladder and wherein the support platform may be releasably and rigidly secured to any one selected vertical rung on the ladder. Ladders including, in particular, extension ladders are in wide use by painters, carpenters, and others for use in performing a wide variety of tasks and undertakings, and platforms with additional support areas are welcomed for use whenever long periods of standing may occur.

Whatever becomes necessary for an individual to stand or otherwise work from a ladder, the legs and feet of the person occupying the ladder typically become uncomfortable due to fatigue along the legs and the soles of his/her feet. Whenever possible, the pressure against the sole of the person's feet becomes reduced when the contact area is expanded. A variety of adjustably positionable support platforms have been proposed in the past, and certain of these have proven to be difficult to adjust, reposition, or otherwise be positioned and/or placed upon a standing ladder. The support platform of the present invention provides a support which is reliable as well as readily adjustable and positionable, and capable of substantially universal application to existing extension ladder designs.

In the past, support platforms which have been known suffer from one or more disadvantages, including difficulty in positioning, limitations upon support area, an excessive number of components contributing to excessive weight, as well as others. The apparatus of the present invention overcomes these difficulties by providing an adjustably positionable support platform which is capable of substantially universal application, and which provides reliable, level, and horizontal support.

SUMMARY OF THE INVENTION

Briefly, in accordance with the present invention, an adjustably positionable support platform particularly adapted for use in combination with conventional extension ladders is provided, with the support platform including a generally planar deck means having a load bearing assembly to accommodate a person standing thereon. Additionally, the load bearing assembly comprises a flat plate with an upper foot supporting surface and a lower rung engaging surface, the lower rung engaging surface being provided for contact with the upper edge surface of one of the ladder rungs. The plate is further provided with angularly downwardly extending flanges which are coupled to the front and rear edges of the plate.

Additionally, first and second pairs of support brackets are secured to the lower rung engaging surface of the plate and positioned generally medially of said front and rear flanges. The first and second pairs of support brackets are provided with a first and second plurality of pin receiving bores respectively, with these bores being formed in said brackets for slidable engagement with a pin member. The first plurality of bores slidably receives a first pair generally horizontally extending rung engaging retaining pins in spaced vertical parallel relationship from said lower rung engaging surface for capturing one of the rungs between pins and the lower rung engaging surface. A second pair of adjustably positionable horizontally extending pins is provided with each of said second pair of pins functioning to adjust the tilt of the platform and extending through one of said second pair of brackets. Each of these second pair of pins carries a ladder rail engaging plate at the forward end thereof for tilt adjustment. The rail engaging plates are typically placed in contact with the front edge surface of one of the vertical rails of the ladder for capturing a rail between the front flange of the assembly and the ladder rail engaging plate. In this fashion, it is possible to securely maintain the support platform on an extension ladder with the platform being reliably secured to the extension ladder in a desired horizontal disposition.

Therefore, it is a primary object of the present invention to provide an improved adjustably positioned support platform for use in combination with an extension ladder, with the support platform having a load bearing deck means to support a person standing thereon, and wherein the support platform may be moved from one vertical disposition to another with relative ease.

It's a further object of the present invention to provide an improved adjustably positionable support platform which includes support brackets which receive pins in slidable engagement therewith and wherein the pins provide a means for ease of attachment and removal of the support platform from a standing extension ladder.

Other and further objects of the present invention will become apparent to those skilled in the art upon a study of the following specification, pending claims and accompanying drawings.

DETAILED DESCRIPTION OF THE PREFERRED EMBODIMENT

Figure 1:
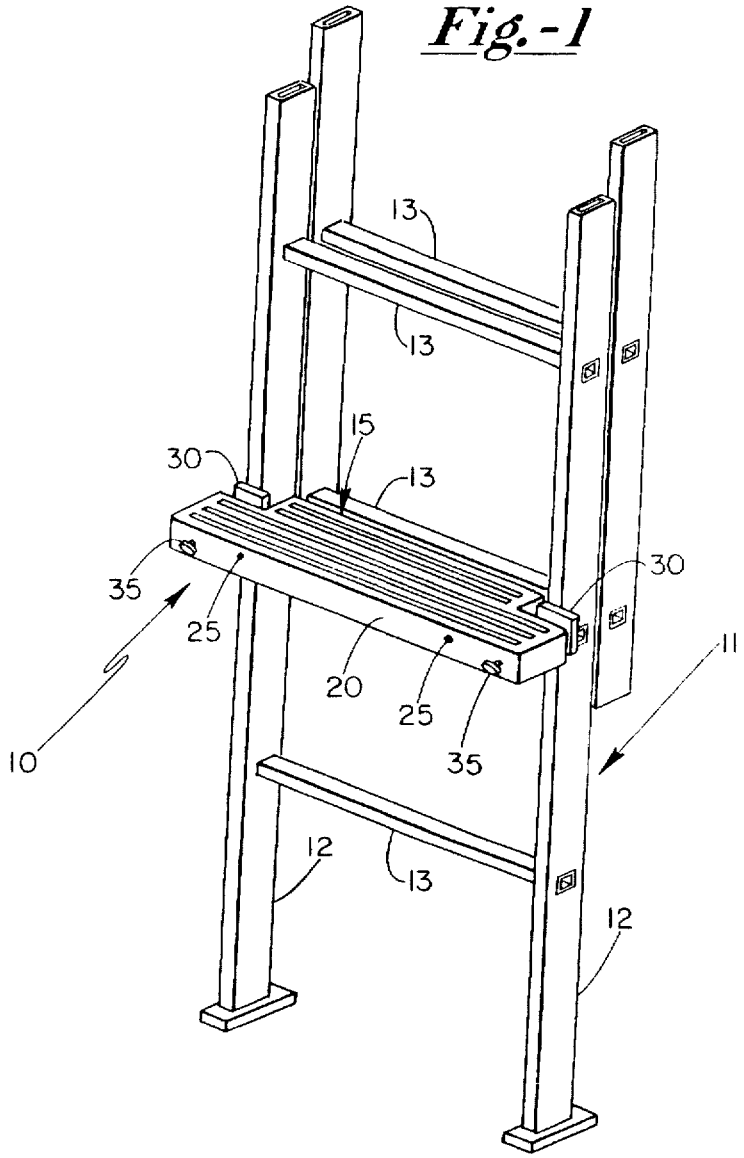
FIG. 1 is a perspective view of the lower segments of a conventional extension ladder, and with the support platform of the present invention being coupled to one of the rungs of the extension ladder.
Figure 2A:
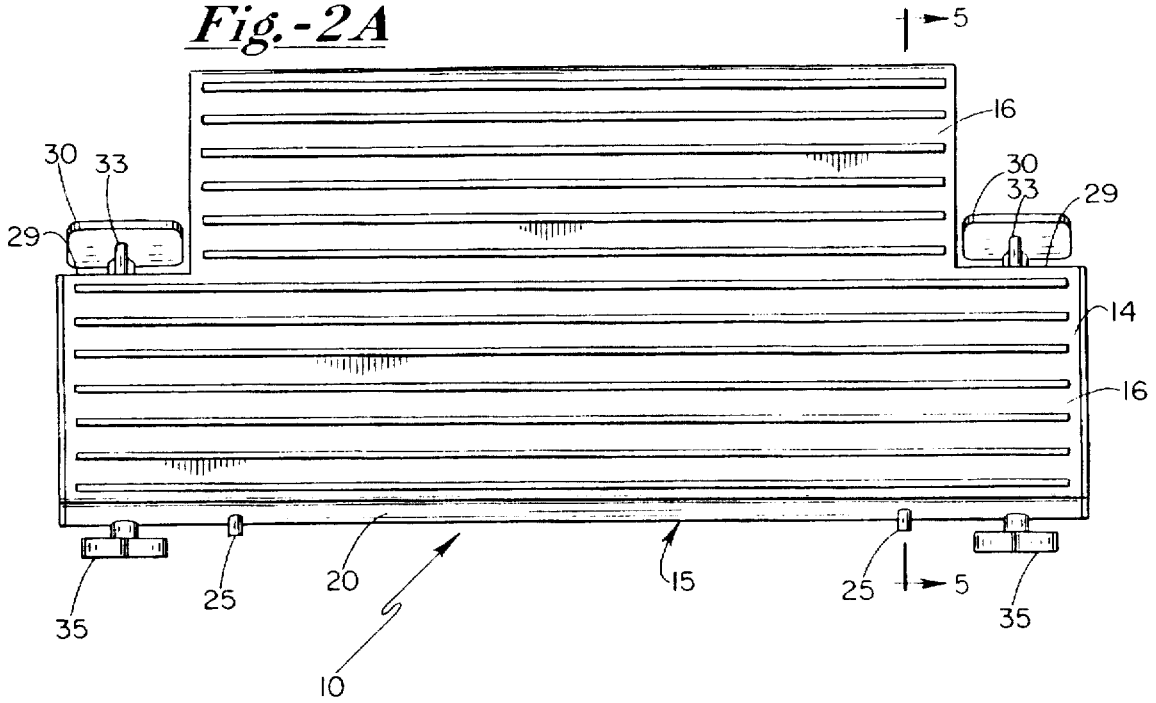
FIG. 2A is a top plan view of the support platform illustrated in FIG. 1.
Figure 2B:
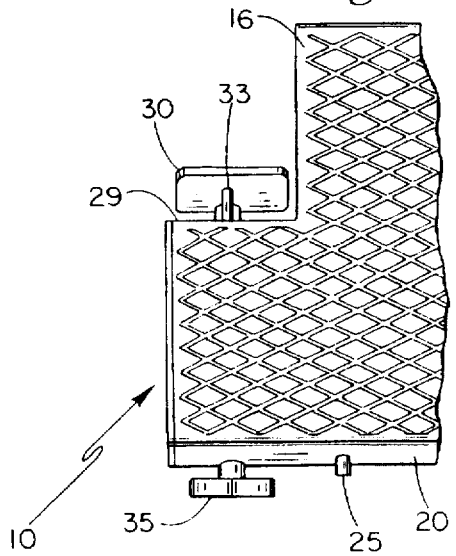
FIG. 2B is a fragmentary top plan view of the support platform of FIG. 2A, but showing an alternate form of support grid on the upper surface thereof.
Figure 3:
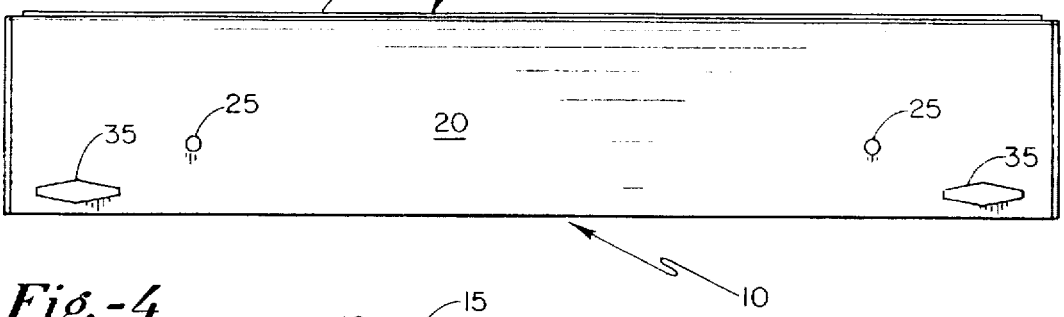
FIG. 3 is a front elevational view of the support platform illustrated in FIG. 1.
Figure 4:
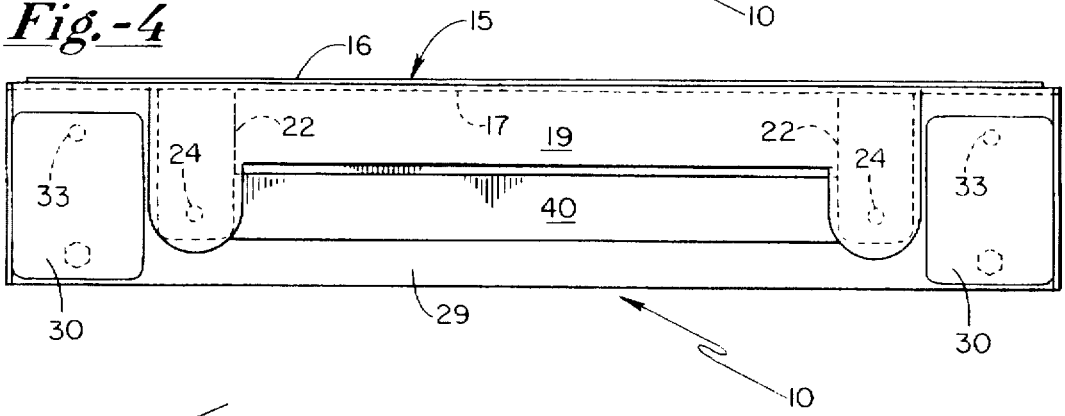
FIG. 4 is a rear elevational view of the support platform illustrated in FIG. 1.

In accordance of the preferred embodiment of the present invention and with particular attention being directed to one of the drawings, the adjustably positionable support platform generally designated 10 is shown attached to ladder 11 along one of its rungs. In particular, ladder 11 includes vertically extending rails 12—12 flanking a plurality of horizontal rungs, such as at 13—13.

With attention now being directed to FIGS. 2A and 2B through 6 inclusive, support platform 10 includes a generally planar deck assembly 14 including a load bearing assembly to accommodate a person standing thereon. The load bearing assembly, in turn, comprises a foot support plate 15 with an upper supporting surface 16 and a lower rung engaging surface 17. The lower rung engaging surface 17 is arranged for contact with the upper surface of one of the rungs 13, such as illustrated in phantom in FIG. 5.

Support plate 15 has an angularly downwardly extending flange 19 coupled to the edge thereof, and an angularly downwardly extending flange 20 extending from the opposed or front edge of plate 15. As is apparent in the drawing, particularly in FIG. 6, angle "A" preferably is an angle of about 75 degrees, with this angle being deemed optimum. The angular relationship is one which provides a proper angle for a properly positioned ladder placed against a vertically extending wall and the ground, with this angle being recognized as standard.

Figure 7:
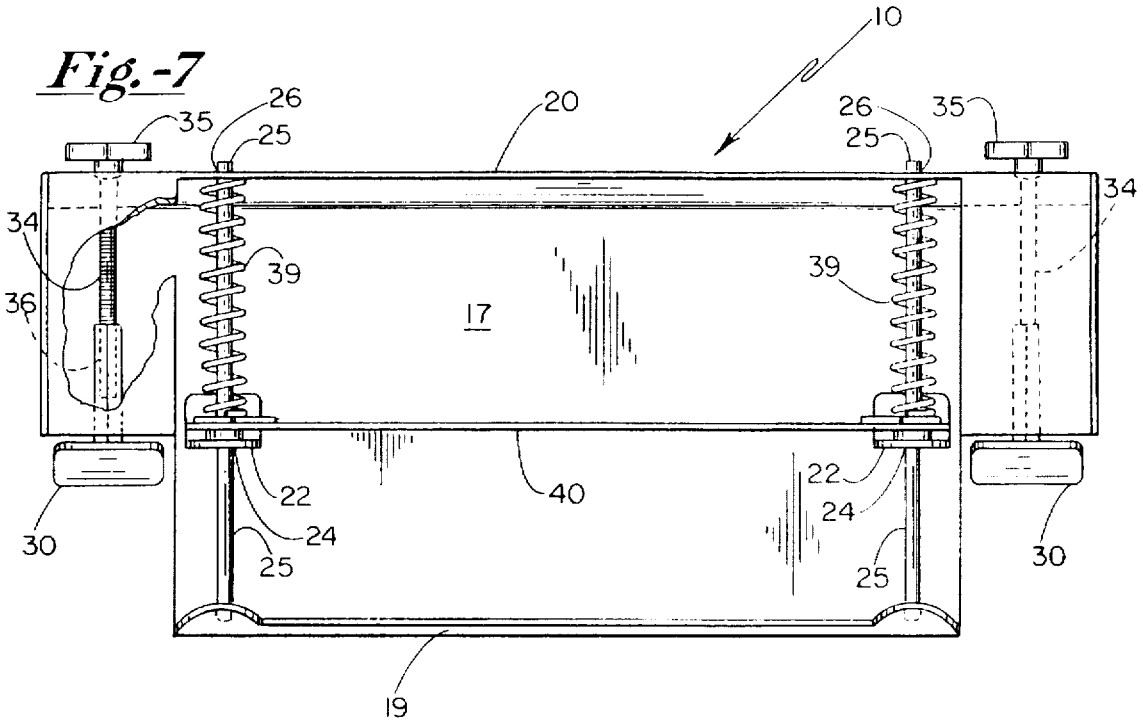
FIG. 7 is a bottom plan view of the support platform shown in FIG. 1.

With attention now being further directed to FIG. 7 of the drawings, a first pair of support brackets is provided at 22—22, with these brackets being disposed generally medially of the front and rear flanges 20 and 19, respectively. Additionally, brackets 22—22 are provided with pin receiving bores as at 24—24. Each of bores 24—24 is conditioned for slidably engaging each of the pair of retaining pin members 25—25 each with outer tips 26—26. It will be noted that pins 25—25 are generally horizontally extending rung engaging pins which capture one of the rungs therebetween, such as rung 13 shown in FIG. 5 between the pins and the plate 15, with the rung engaging pins being positioned in parallel relationship to plate 15.

A second pair of adjustably positionable horizontally extending threaded shafts or pins are provided as at 34–34 for tilt adjustment. Pins 28—28 pass through second brackets as at 29—29, and with each pin 34 carrying a ladder rail engaging plate 30 forwardly thereof. Plate 30 is designed for engagement with the front edge surface of one of the vertical ladder rails and plate 30, with plate 30 together with the rear surface 31 of flange 19 capturing one of the vertical ladder rails therebetween. For added stability, stabilizing pins as at 33—33 are provided.

In order to control the position of plates 30, threaded shaft or pin 34 is arranged for hand rotation with a gripping knob 35. Shaft 34 is captured within a threaded bore in flange 20 so that rotation of shaft 34, in turn, moves internally threaded cylinder 36, thereby providing for adjustable positioning of plates 30—30. Double-ended arrow 37 illustrates the motion achieved.

Figure 5:
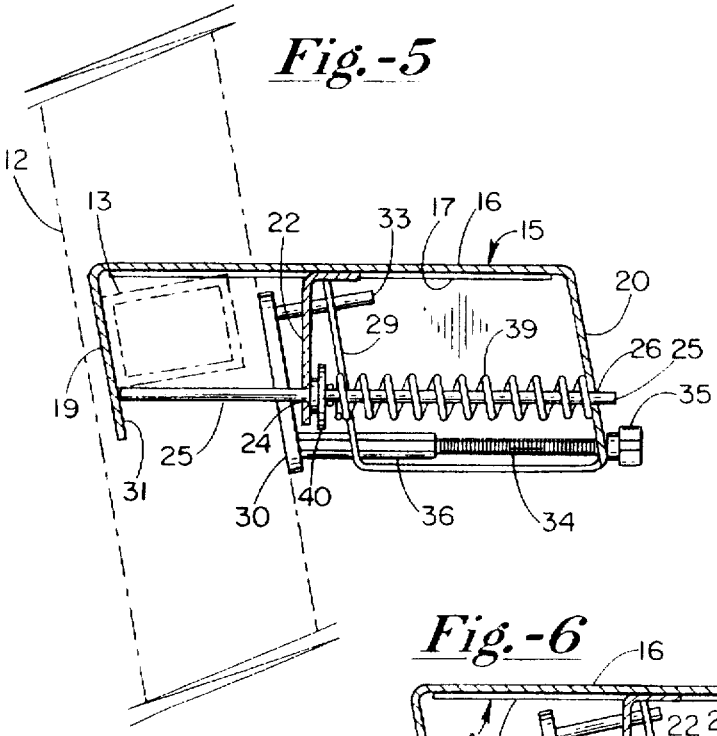
FIG. 5 is a vertical sectional view taken along the line and in the direction of the arrows 5—5 of FIG. 2A and showing a ladder rail and rung in phantom.
Figure 6:
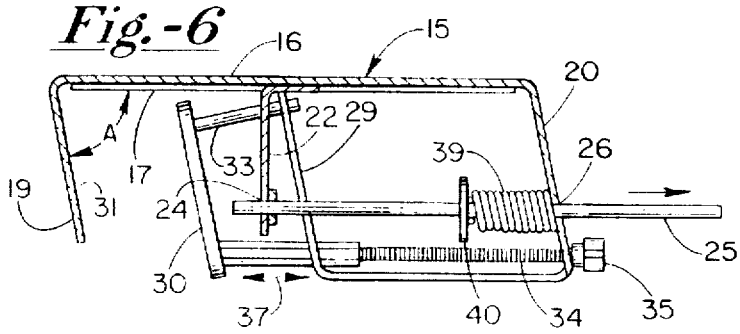
FIG. 6 is a view similar to FIG. 5 with the phantom portions removed, and with the rung engaging pins being in retracted position.

With continued attention being directed to FIGS. 5, 6, and 7, resilient spring members 39—39 are provided to resiliently bias retaining pins 25—25 forwardly and hence, through bores formed in flange 20, as well as in brackets 22—22. A finger or hand-gripping bracket 40 is provided, so that upon retraction of member 40 toward front flange 20, pins 25—25 will be in the disposition illustrated in FIG. 6. Since springs 39—39 resiliently bias pins 25 normally to a forward position, when bracket 40 is released, the pins will assume the disposition illustrated in FIG. 5.

Figure 8:
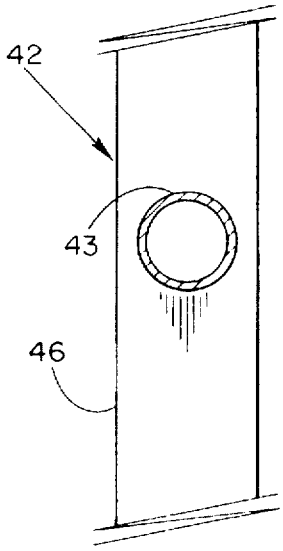
FIGS. 8 and 9 are fragmentary views of an extension ladder and illustrating ladder rungs of alternative configuration.
Figure 9:
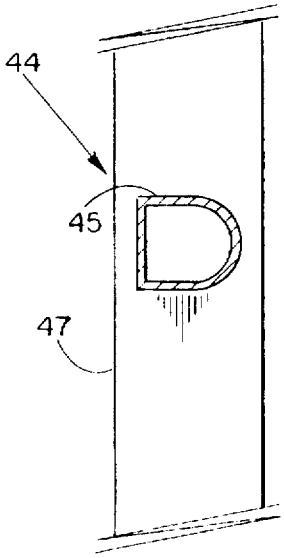

With attention now being directed to FIGS. 8 and 9, it will be noted that ladder segment 42 is provided with cylindrical rungs as at 43, while ladder segment 44 is provided with a modified form of rung as at 45. Each of the ladder segments illustrated in FIGS. 8 and 9 include vertically arranged rails 46 and 47 respectively. These ladders are, of course, in common use and well known in the art. One advantage of the rung configuration illustrated in FIG. 9 is that there is a somewhat greater area available for foot support, however, the support platform of the present invention provides substantially greater area and thus provides for a reduction in unit pressures to which the user's feet, including the arch areas, are exposed.

The combination of features available in the apparatus of the present invention enables the user to readily reposition the step platform at any desired point along a ladder. The utilization of spring biased retainer pins such as pins 25—25 enable both the release of the step platform as well as re-attachment of the step platform in a convenient and expedient fashion. The threaded tilt adjustment pin provide an expedient means for retaining the step platform at a desired position, substantially along a horizontal plane. When a ladder is repositioned, and when the repositioning requires a tilt of the ladder at an angle greater than, for example, 15 degrees, then and in that event, the step platform of the present invention may be adjusted to accommodate such a tilt and at the same time provide a substantially horizontal and level support platform.

DESCRIPTION OF ALTERNATIVE PREFERRED EMBODIMENT

Figure 10:
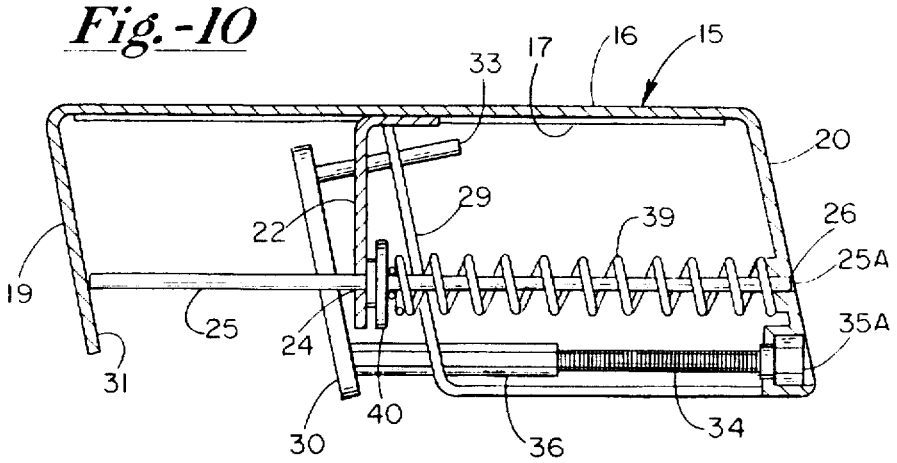
FIG. 10 is similar to FIG. 5 in illustrating a configuration of an alternate preferred embodiment.

With attention now being directed to FIG. 10 of the drawings, and with continued attention being directed to FIG. 5 of the drawings, it will be observed that the head portions 25A and 35A of pin members 25 and shaft 34 are recessed within downwardly extending flange 20. This configuration, providing recessed or counter-sunk members presents a uniform flat planar front configuration which smooths the surface and reduces interference.

It will be appreciated that the specific embodiments illustrated herein are provided for illustrative purposes and that those skilled in the art depart from the specific example without departing from the spirit and scope of the present invention.

What is claimed:

1. An adjustably positionable support platform for use in combination with a ladder having a pair of generally vertically extending rails flanking a plurality of horizontal rungs and comprising:

(a) deck means having a load bearing assembly to accommodate a person standing thereon with said load bearing assembly comprising a plate with an upper foot supporting surface for accommodating a person along with a lower rung engaging surface for supporting contact with the top surface of one of said rungs, said plate further having angularly downwardly extended flanges coupled thereto adjacent the forward and rear edges thereof;

(b) a first pair of pin receiving support brackets and a second pair of pin receiving support brackets secured to said plate along said lower rung engaging surface medially of said front and rear edges and having a first plurality of pin receiving bores and a second plurality of pin receiving bores, each bore adapted for slidable engagement with a pin member;

(c) said first plurality of bores adapted to receive a first pair of generally horizontally extending rung engaging pins in spaced apart vertical parallel relationship from the lower rung engaging surface of said plate for capturing one of said rungs between said rung engaging pins and said lower rung engaging surface;

(d) a second pair of adjustably positionable generally horizontally extending pins, with each pin extending through one of said second pair of brackets and with each of said second pins carrying a ladder rail engaging plate forwardly thereof for engagement with the front edge surface of one of said ladder rails and for capturing one of said vertical ladder rails between said forward flange and said ladder rail engaging plate; and (e) said first pair of pins are resiliently biased forwardly toward said front downwardly extending flange.

2. The adjustably positionable support platform as defined in claim 1 being particularly characterized in that gripping bar means are coupled to said first pair of pins to simultaneously retract said first pair of pins away from said front downwardly extending flange.

3. The adjustably positionable support platform as defined in claim 1 being particularly characterized in that said second pair of adjustably positionable horizontally extending pins includes a threaded member for positioning said ladder rail engaging plate in a spaced relationship to said front flange.

4. The adjustably positionable support platform as defined in claim 1 being particularly characterized in that a stabilizing bracket is provided, secured to the said lower rung engaging surface and extending downwardly therefrom, and with a third pair of pin receiving bores being provided one in each of said stabilizing bracket for slidable engagement with a pin member, and wherein a pair of stabilizing pins are provided, with one of said stabilizing pins being attached to the rear surface of each of said ladder rail engaging plates, said pair of stabilizing pins being positioned between said second pair of pins and said lower rung engaging surface.

* * * * *